US005913184A

United States Patent [19]

Girbig

[11] Patent Number: 5,913,184

[45] Date of Patent: Jun. 15, 1999

[54] METHOD AND DEVICE FOR DIAGNOSING AND PREDICTING THE OPERATIONAL PERFORMANCE OF A TURBINE PLANT

[75] Inventor: Paul Girbig, Uttenreuth, Germany

[73] Assignee: Siemens Aktiengesellschaft, Munich, Germany

[21] Appl. No.: 08/782,149

[22] Filed: Jan. 13, 1997

Related U.S. Application Data

[63] Continuation of application No. PCT/DE95/00892, Jul. 7, 1995.

[30] Foreign Application Priority Data

Jul. 13, 1994 [DE] Germany ..... 44 24 743

[51] Int. Cl.[6] ..... G01L 5/00

[52] U.S. Cl. ..... 702/182; 702/183; 364/578

[58] Field of Search ..... 702/182, 183, 702/189, 33, 44, 45, 47, 50, 98, 100, 105, 138; 701/99, 100; 364/149–151, 578, 141, 146, 164, 184, 188, 528.1, 528.22, 528.25; 73/117.3, 116, 117.1, 117.2, 112; 60/39.24, 39.75; 706/906, 907, 914, 915, 646

[56] References Cited

U.S. PATENT DOCUMENTS

| | | | |
|---|---|---|---|
| 4,027,145 | 5/1977 | McDonald et al. | 364/528.22 |
| 4,135,246 | 1/1979 | McMannis | 701/100 |
| 4,181,840 | 1/1980 | Osborne | 364/528.25 |
| 4,249,238 | 2/1981 | Spang, III et al. | 701/100 |
| 4,467,640 | 8/1984 | Morrison | 73/117.3 |
| 4,577,270 | 3/1986 | Sugano et al. | 364/151 |
| 5,042,295 | 8/1991 | Seeley | 73/117.3 |
| 5,201,180 | 4/1993 | Girbig | 60/646 |
| 5,402,332 | 3/1995 | Kopf | 364/528.22 |
| 5,598,329 | 1/1997 | Niemann | 364/151 |
| 5,734,567 | 3/1998 | Griffiths et al. | 364/184 |

FOREIGN PATENT DOCUMENTS

| | | |
|---|---|---|
| 34 21 522 A1 | 12/1984 | Germany . |
| 36 33 402 A1 | 4/1987 | Germany . |
| 35 41 148 A1 | 5/1987 | Germany . |
| 42 34 210 A1 | 4/1994 | Germany . |

OTHER PUBLICATIONS

"Micromachine simulation of steam power plant", IEEE vol. 121, No. 6, Jun. 1974, pp. 491–499.

"Dynamic Models for Fossil Fueled Steam Units in Power System Studies", IEEE Transactions on Power Systems, vol. 6, No. 2, May 1991, pp. 753–761.

*Primary Examiner*—Hal Dodge Wachsman

*Attorney, Agent, or Firm*—Herbert L. Lerner; Laurence A. Greenberg

[57] ABSTRACT

A method and a device for diagnosing and predicting the operational performance of a turbine plant use a plant model determined from plant-specific characteristics to determine at least one further operating parameter, in order to establish a deviation of a current operating state from an ideal state and in order to predict a reaction of the turbine plant to changing boundary conditions, given the stipulation of an operating parameter, during operation of such a turbine plant. The device includes a computer module which accesses a model memory for the plant model, in order to calculate individual operating parameters with the aid of the plant model.

8 Claims, 2 Drawing Sheets

METHOD AND DEVICE FOR DIAGNOSING AND PREDICTING THE OPERATIONAL PERFORMANCE OF A TURBINE PLANT

CROSS-REFERENCE TO RELATED APPLICATION

This application is a Continuation of International Application Serial No. PCT/DE95/00892, filed Jul. 7, 1995, designating the United States.

BACKGROUND OF THE INVENTION

Field of the Invention

The invention relates to a method and a device for diagnosing and predicting the operational performance of a turbine plant, for example a steam or gas turbine plant.

Such a turbine plant is operated under prescribed boundary conditions or operating parameters, and the efficiency of the plant is determined metrologically. Thus, for example, steam turbines for driving compressors or generators are installed in industrial plants and operated in conjunction with changing operating states, that is to say with different steam quantities for different steam states (steam pressure and steam temperatures). If deviations of the current operating parameters from the planned operating data occur during operation, that will be reflected in the measured values. A device for diagnosing measurement errors and for correcting them in a control system of a gas turbine plant is known from U.S. Pat. No. 4,249,238.

In that case, there is usually no direct comparison of the actual operating parameters with measured data which were determined at an earlier instant. The cause thereof is changing operating conditions which scarcely permit identical operating states to be approached repeatedly in order to determine the current efficiency without disturbing the overall operation of the plant. If, in addition, the boundary conditions, that is to say the individual operating parameters under which the steam turbine is operated, deviate from those during the initial startup, the estimates of the state of the plant, which are based exclusively on the current measured values, are bound up with many assumptions and a high inaccuracy.

SUMMARY OF THE INVENTION

It is accordingly an object of the invention to provide a method and a device for diagnosing and predicting the operational performance of a turbine plant, which overcome the hereinafore-mentioned disadvantages of the heretofore-known methods and devices of this general type, which permit the performance of the turbine plant to be reproduced even given deviations of individual operating parameters or boundary conditions from planned operating data and which do so by using simple provisions.

With the foregoing and other objects in view there is provided, in accordance with the invention, a method for diagnosing and predicting the operational performance of a turbine plant, which comprises determining a plant model from plant-specific characteristics; prescribing an operating parameter for the plant model; and determining at least one further operating parameter with the plant model.

The modeling of the plant is based on the layout and construction data such as, for example, geometries and materials of turbine blades and other plant components of the respective turbo-generator constructed from a turbine and a generator. All of the required characteristics of the turbine, of a gear unit which is possibly used, and of the generator are integrated, while taking account of the part-load performance, in the calculation which is preferably implemented through the use of software.

In accordance with another mode of the invention, with respect to the diagnosis, the method permits a comparison of the current operating parameters with calculated model data of the turbine plant, and thus shows deviations of the current parameters from the expected operating data of the model calculation. Consequently, for the purpose of establishing such a deviation it is advantageous to compare a current measured operating state with a calculated desired value, with at least one metrologically determined operating parameter being prescribed for the purpose of calculating the desired value.

In accordance with a further mode of the invention, this current measured operating state and the calculated desired value are displayed simultaneously.

With respect to the prediction, the method permits the stipulation of desired boundary conditions or operating parameters, with the reaction of the modeled turbine plant to the desired boundary conditions being calculated. This advantageously permits the turbine plant to be integrated into an industrial plant, for example a paper mill. The prescribed operating parameter can thus be a manually selected value or a measured value.

With the objects of the invention in view there is also provided a device for diagnosing and predicting the operational performance of a turbine plant, comprising a model memory for a plant model determined from plant-specific characteristics; and a computer module associated with the model memory for calculating individual operating parameters, an operating parameter being prescribed for the plant model, and at least one further operating parameter being determined by the plant model.

The plant model, which is based on the plant-specific characteristics or design data of the turbine plant is advantageously produced in a single computing operation and stored in the model memory as a computer program.

In accordance with another feature of the invention, in order to be able to change or exchange these design data, there is provided a design database for storing the plant-specific characteristics.

In accordance with a concomitant feature of the invention, there is provided an operating module in order to be able to feed the computer module individual measured values for diagnostic purposes, on one hand, and the manually prescribed operating parameters for predictive purposes, on the other hand. Current measured values are input through this operating module, or selected operating parameters are prescribed.

The advantages achieved with the invention are, in particular, that the performance of the turbine plant can be determined by calculating individual operating parameters through the use of the plant model even if the prescribed boundary conditions or operating parameters, for example a current steam condition, do not correspond to those operating data which were used in constructing the turbine plant. In the case of a manual stipulation of operating parameters, prediction of the reaction of a turbine plant to changing operating parameters is possible even if the manually prescribed operating parameters deviate from the operating parameters which are current in the on-line operation. Fault sources can be diagnosed from a deviation which can be established by comparing the respectively measured and calculated operating parameters or operating states. Thus, it is possible to draw conclusions regarding faults in the instrumentation or changes in the steam turbine plant, for example regarding the formation of a coating on the turbine blades, from such a deviation.

Other features which are considered as characteristic for the invention are set forth in the appended claims.

Although the invention is illustrated and described herein as embodied in a method and a device for diagnosing and predicting the operational performance of a turbine plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
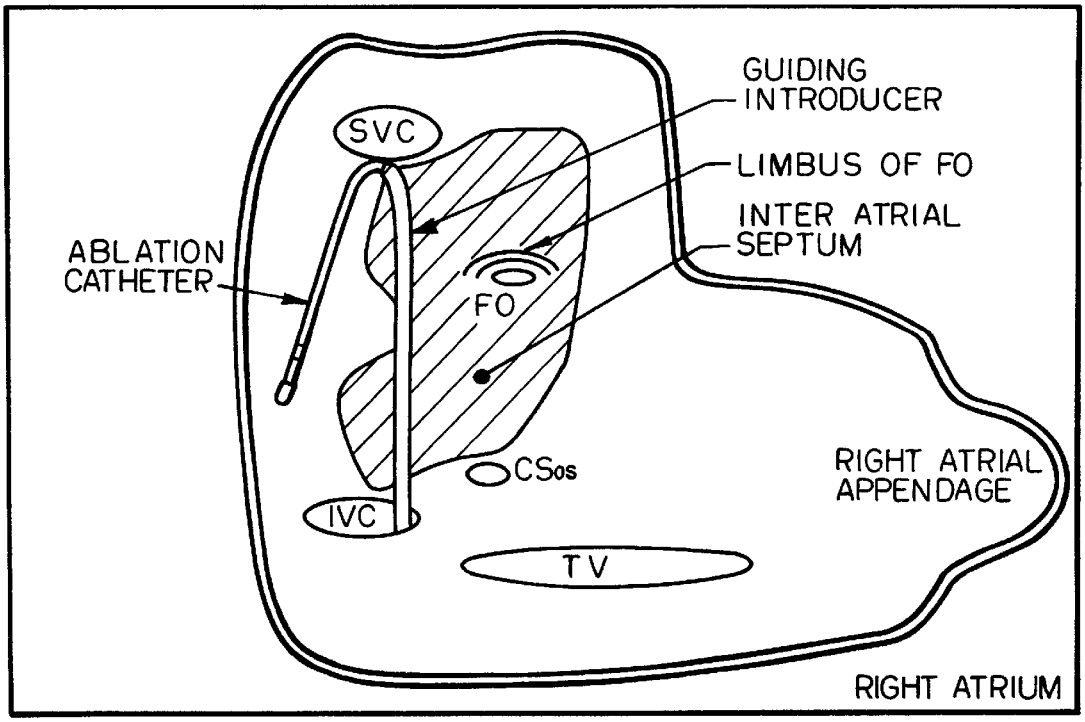
FIG. 1 is a diagrammatic view of a steam turbine plant and a schematic and block circuit diagram of a diagnosing and predicting device, according an exemplary embodiment of the invention.

Referring now to the figures of the drawings in detail and first, particularly, to FIG. 1 thereof, there is seen a diagrammatically represented steam turbine plant 1 that includes a multistage steam turbine 2 and a condenser 4 as well as a generator 6 which is driven by the steam turbine 2 through a gear unit 8. The exemplary embodiment concerns a condensation turbine having a high-pressure section 2*a* and a low-pressure section 2*b*. An inlet side of the low-pressure section 2*b* is connected through a steam pipe 10, into which a valve 12 is connected, to the high-pressure section 2*a*. Moreover, an outlet side, that is to say an exhaust end, of the low-pressure section 2*b* is connected through an exhaust steam pipe 14 to the condenser 4. A main-steam pipe 17, into which a valve 18 is connected, opens into an inlet 16 of the high-pressure section 2*a* of the steam turbine 2. The high-pressure section 2*a* is provided with a bleed pipe 19 and with an extraction pipe 20, through which steam can be bled respectively from different stages of the steam turbine 2.

The turbine plant 1 has measuring points $P_n$, $T_n$, $Q_n$ wherein n=1 to 4, which reproduce as measured values MW1 to MW4 the boundary conditions for operating parameters under which the turbine plant 1 is operated. Thus, pressure p, temperature T and quantity Q of the steam in the steam pipes 14, 17, 19 and 20 can be measured as operating parameters.

Likewise, the condenser 4 has measuring points K which reproduce as measured values MW5 the operating parameters under which the condenser 4 is operated. The generator 6 also has measuring points I, U for the purpose of measuring a generator current I and a generator voltage U. The measuring points I, U reproduce as measured values MW6 the operating parameters under which the generator 6 is operated, that is to say a generator or terminal output P.

The measured values MW1 to MW6 are fed to a data line or databus 21. The databus 21 is connected to a device 22 for data processing. The device 22 is used to diagnose the operational performance of the turbine plant, that is to say to determine the plant state in on-line operation. It is likewise used for prediction, that is to say for the advance determination of the performance of the turbine plant 1 under the prescribed operating parameters $P_n$, $T_n$, $Q_n$ and/or P.

In order to achieve as high a quality as possible for the precalculation, a cyclically activated matching of a model determined from plant-specific characteristic data or characteristics KG to the actual operating state of the steam turbine 2 is provided. For this purpose, the characteristics KG of the individual turbine data such as, for example, shaft diameter, cross-sections, gap widths and profiles, are stored in a design database 24 of the device 22. In other words, all of the known mechanical construction data of the steam turbine 2, the condenser 4, the generator 6 and, as the case may be, the gear unit 8, are stored there as characteristics KG. The characteristics KG can be input, exchanged or altered at any time through an operating module 26, for example during initial startup or during retrofitting of the turbine plant 1.

Based on the characteristics KG, a single computing operation is used to produce a model of the plant components 2, 4 and 6, and to store it as a computing program in a model memory 28. The model memory 28 is part of a model calculation which is carried out through the use of a computer module 30. To the extent that the gear unit 8 is used in the turbine plant 1, this is taken into account in the model calculation.

In the case of an on-line analysis, which can also be carried out for part-load ranges and independently of the current operating state of the turbine plant 1, a diagnosis DG is selected through the operating module 26 in order to determine the current plant state, and a prediction PG is selected for the purpose of determining in advance the performance of the turbine plant 1 under changed boundary conditions.

If the diagnosis DG is selected through the use of the operating module 26 of the device 22, the measured values MW1 to MW6 are fed to the model calculation carried out in the computer module 30. The boundary conditions or operating parameters $P_n$, $T_n$, $Q_n$, among which the performance of the turbine plant 1 is to be predicted, can be prescribed manually through a data input module 34. If the prediction PG is selected through the use of the operating module 26, this manual stipulation is fed to the model calculation carried out in the computer module 30.

The model computer will be explained in the following on the basis of the flow diagram of FIGS. 2A and 2B:

The computer module or model computer 30 starts the model calculation after a manual operating command (starting value). For the purpose of modeling the turbine plant 1, in this case the model calculation goes back to the characteristics KG that are present in the design database. In so doing, all of the required characteristics KG for the steam turbine 2, for the generator 6 and, in the case of a condensation turbine, for the condenser 4 as well as for the gear unit 8 which is possibly used, in particular while taking account of the part-load performance of the turbine plant 1, are integrated into the model calculation. Thus, for example, performance and efficiency characteristic curves of the gear unit 8 and of the generator 6 are also defined in the turbine model and stored in the model memory 28. The model calculation is expediently implemented by a computer program that is to say by software.

The outputs generated in the steam turbine 2 at each stage are determined as a function of the steam conditions prevailing there, that is to say the steam pressure p and the steam temperature T. In this case, all of the steam quantities $Q_n$ in the main steam pipe 17, from the exhaust steam pipe 14, from the bleed pipe 19 and from the extraction pipe 20 go into the model calculation. The pressure characteristics in the steam turbine 2 are calculated through the use of the computer module 30 and matched by iterative computing operations to the conditions of the turbine plant 1.

The model calculation is carried out in such a way that it can be accessed in various ways. The background to this is that the turbine model is used to determine the performance of the steam turbine 2, but also, for example, of a gas turbine, under various boundary conditions or for various operating parameters. In order to precalculate a specific turbine output or terminal output P with the aid of the model calculation, the steam quantity $Q_1$ fed to the steam turbine 2 and the associated steam conditions, that is to say the steam pressure $P_1$ and/or the steam temperature $T_1$, for example, can be defined as operating parameters.

In another case, the turbine output or terminal output P can also be defined as an operating parameter, and the requirement can exist to calculate the steam quantity $Q_1$ required by the steam turbine 2 through the use of the model calculation. Matching of the model calculation to the current state of the turbine plant 1 is undertaken in this case by inputting parameters for tolerances and aging phenomena, and therefore it is possible to go back to this current state of the turbine plant 1 in the case of a predictive calculation.

The first step in the model calculation is to calculate the losses as a function of the steam conditions set at the individual stages of the steam turbine 2, such as steam pressure p and steam temperature T. Subsequently, the characteristics KG are used to calculate the theoretical thermal efficiency at the individual stages of the steam turbine 2. The calculation of the theoretical thermal efficiency of each stage is performed as a function of the steam conditions p, T set at the individual stages. The theoretical thermal efficiency is understood as the theoretically possible optimum of the heat utilization. The theoretical thermal efficiency is reduced by the calculated losses, and the effective efficiency of each stage is determined from this in a so-called forward calculation. In this case, the efficiency is calculated by stage in the direction of steam flow from the turbine inlet 16 up to the exhaust end on the exhaust steam pipe 14. The respectively determined effective efficiency of a stage (for example, of a third stage) determines the steam conditions p, T at the following stage (for example, the fourth stage). The steam conditions p, T which are determined are in turn decisive for the calculation of the efficiency at this following stage (the fourth stage) and after the calculation they lead to steam conditions p, T which in turn influence the following stage (for example the fifth stage), etc. This calculation of the effective efficiency is performed at all turbine stages in a successive sequence from the turbine inlet 16 up to the exhaust end, that is to say up to the outlet of the low-pressure section 2*b*. During the forward calculation, all steam quantities $Q_n$ from the main-steam pipe 17, the exhaust steam pipe 14, the bleed pipe 19 and the extraction pipe 20 are taken into account as a function of the steam conditions $p_n$, $T_n$ respectively prevailing there. The steam conditions $p_n$, $T_n$ determined during the efficiency calculation yield steam pressures downstream of the individual stages of the steam turbine 2 which drop to a calculated counterpressure up to the exhaust end.

However, on the basis of the plant conditions, the steam turbine 2 can also feed an exhaust steam pressure $p_4$ which is defined in plant-specific terms and deviates from the calculated exhaust steam pressure. The exhaust steam pressure $p_4$ that is defined in plant-specific terms can, for example, also be prescribed manually as an operating parameter during the prediction PG. In the case of a deviation in the exhaust steam pressure $p_4$ from the calculated exhaust steam pressure, wherein the deviation is defined in plant-specific terms or is measured, it is observed in computational terms by a backward calculation through an interrogation of the difference, that the forward calculation has resulted in a divergent pressure characteristic in the steam turbine 2.

In the case of the backward calculation, the built-up pressure or pressure characteristic in the steam turbine 2 is calculated starting from the exhaust end up to the steam inlet 16. During the backward calculation, the steam quantity $Q_1$ in the fresh or main-steam line 17 and the steam quantities $Q_2$, $Q_3$, $Q_4$ in the extraction pipe 20, in the bleed pipe 19 and in the exhaust steam line 14 are determined anew as a function of the steam pressures $P_1$, $P_2$, $P_3$ and $P_4$ and the steam temperatures $T_1$, $T_2$, $T_3$ and $T_4$ respectively prevailing there. In this case, steam quantities emerging at sealing discs of the steam turbine 2 are also determined from a comparison between the steam quantity $Q_1$ entering the steam turbine 2 and the steam quantities $Q_2$, $Q_3$ and $Q_4$ bled from the steam turbine 2. If the steam quantities $Q_n$ in the pipes 14, 17, 19 and 20 have been determined anew, a forward calculation is restarted. Forward calculation and backward calculation are performed in an alternating fashion until a specifiably small deviation is established between the calculated and the measured exhaust steam pressure $p_4$. This is followed by a controlled termination of the iterative computing operation. The iteration method can also be automatically terminated at a settable maximum deviation.

The sum of the individual stage outputs is used to calculate the turbine output and thus the terminal output P from the calculated steam quantities $Q_n$ and the calculated effective efficiency per stage of the steam turbine 2, while also taking possible losses into account, for example, at a turbine control valve. If, by contrast, the required steam quantity $Q_1$ at the turbine inlet 16 is to be calculated for a prescribed turbine output or terminal output P, an iteration method will carry out the forward calculation and backward calculation in an alternating fashion as described above, until the prescribed total turbine output is reached.

Once the model calculation is terminated, the results of the computation are displayed on a screen system 36. The current measured values MW1 to MW6 and the operating parameters p, T, Q and/or P prescribed in the case of the prediction PG can be called up, together with the corresponding calculated operating parameters, on the screen system 36. In this case, it is preferable for two diagrams 37 and 38 to be made available.

The diagram 37 is a consumption diagram in which a steam consumption curve 40 having an operating point 41 determined through the use of the model calculation and an operating point 42 determined from the measured values MW1 to MW6, are represented for a steam turbine plant 1.

The diagram 38 is a plant flow diagram with a symbolic representation of the steam turbine 2 and of the spatial assignment of the measuring points $p_n$, $T_n$, $Q_n$ (n=1, 2, 3, 4) and display fields 44 to 48. Exhaust steam parameters are displayed in the display field 44, bleed parameters in the display field 45, extraction parameters in the display field 46 and main-steam parameters in the display field 47. The terminal output P at the generator 6 is displayed in the display field 48. Each display field 44 to 48 is subdivided for the purpose of displaying the prescribed, the corresponding calculated and the common operating parameter $p_n$, $T_n$, $Q_n$, P.

In the case of diagnosis, the two diagrams 37 and 38 make it possible to compare the turbine plant 1 with the model calculation for determining deviations. In the case of prediction and given the stipulation of an operating parameter $p_n$, $T_n$, $Q_n$ or P, which is displayed in the corresponding display field 44 to 48, the further operating parameters $p_n$, $T_n$, $Q_n$ and P which are respectively calculated through the use of the plant model determined from the plant-specific characteristics KG, are displayed in the corresponding display fields 44 to 48, with the result that the reaction of the turbine plant 1 becomes visible.

If, for example, the terminal output P at the generator 5 is prescribed, all of the other operating parameters $p_n$, $T_n$, $Q_n$ of the turbine plant 1 are calculated through the use of the model computer 30 by the turbine model. The measured terminal output P, the prescribed operating parameter for the terminal output and the calculated value for the terminal output are then displayed in the display field 48 in the diagram 38. The measured and the calculated operating parameters for steam pressure $p_n$, steam temperature $T_n$ and steam quantity $Q_n$ are correspondingly displayed, spatially assigned, in the corresponding display fields 44 to 47. In addition, given a selection of the diagram 37 having an abscissa on which the terminal output P and an ordinate on which the main-steam quantity $Q_1$ are plotted, the calculated operating point 41 within the steam consumption curve 40 and the measured operating point 42 are represented. In addition, the measured and calculated main-steam quantity $Q_1$ are displayed together with the measured and calculated terminal output P on respective display fields 49 and 50. If differences are seen between measured and calculated operating parameters, as in the exemplary embodiment, the cause thereof can be faults in the measuring instrumentation or changes in the steam turbine plant 1. A comparison of parameters using the diagram 38 points to whether there is a change in the measuring instrumentation or, for example, the steam turbine 2. Thus, for example, the measured operating parameters can indicate the formation of a coating on the blades of the turbine. A direct comparison between the measured and the calculated turbine output or terminal output P explains the output difference arising or the lower power generation. Such information helps the user of the steam turbine plant 1, for example in determining the correct instant for a revision.

If, by contrast, production-induced changes in the operating parameters $p_n$, $T_n$ or $Q_n$ are being considered for the steam turbine 2, it is of interest to the user to know the effects on the steam turbine 2. The user is then capable of prescribing new operating parameters $p_n$, $T_n$ or $Q_n$ through the operating module 26. The spatial assignment and the permissible operating ranges of the respective operating parameters are displayed in the diagram 38. If the model calculation is started after stipulation of the desired operating parameter, a visualization of the calculated operating parameters and a representation of the precalculated operating point 41 is performed in the diagram 37 within a short time, that is to say in the range of seconds. Production-induced changes in the operating parameters and the effects of the latter on the steam turbine 2 can thus be calculated in advance. If, in this case, the operating parameters $p_n$, $T_n$, $Q_n$ and/or P still permit clearances, the part-load performance of the turbine plant 1 under variable operating parameters can also be included in an automatic or closed-loop control concept.

The above-described diagnosing and predicting device 22 can also advantageously be incorporated into an already existing instrumentation and control system of the steam turbine plant 1.

I claim:

1. A method for calculating the operational performance of a turbine plant, which comprises:

determining a turbine plant model from turbine plant-specific characteristics by an iterative procedure, the iterative procedure including a forward calculation and a backward calculation, the forward calculation following a steam-flow and calculating an effective efficiency per turbine stage, the backward calculation starting from an exhaust end and calculating a pressure characteristic in a steam turbine in the turbine plant;

prescribing an operating parameter for the turbine plant model; and determining at least one further operating parameter with the prescribed operating parameter and the turbine plant model.

2. The method according to claim 1, which comprises comparing a current measured operating state with a calculated desired value of the operating state for establishing a deviation, and prescribing at least one metrologically determined operating parameter for calculating the desired value.

3. The method according to claim 2, which comprises simultaneously representing the currently measured operating state and the calculated desired value.

4. The method according to claim 1, which comprises manually prescribing at least one operating parameter for precalculating the performance of the turbine plant.

5. The method according to claim 4, which comprises simultaneously displaying at least one precalculated operating parameter and each corresponding, metrologically determined operating parameter.

6. A device for calculating the operational performance of a turbine plant, comprising:

a model memory for a turbine plant model determined from the turbine plant-specific characteristics, said model memory storing an iterative procedure, the iterative procedure including a forward calculation and a backward calculation, the forward calculation following a steam-flow and calculating an effective efficiency per turbine stage, the backward calculation starting from an exhaust end and calculating a pressure characteristic in a steam turbine in the turbine plant; and a computer module connected to said model memory for calculating individual operating parameters, said computer module using a prescribed operating parameter for the turbine plant model and determining at least one further operating parameter with the turbine plant model.

7. The device according to claim 6, including a design database connected to said model memory for storing the turbine plant-specific characteristics.

8. The device according to claim 6, including an operating module connected to said computer module for inputting current measured values and for prescribing selected operating parameters.

* * * * *

UNITED STATES PATENT AND TRADEMARK OFFICE

CERTIFICATE OF CORRECTION

PATENT NO. : 5,913,184

DATED : Jun. 15, 1999

INVENTOR(S) : Paul Girbig

Figure 2C:
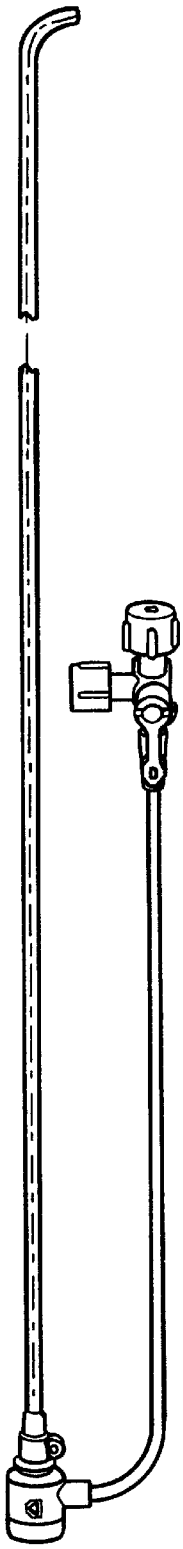
FIGS. 2A and 2B are parts of a function chart of the diagnosing and predicting device for the steam turbine plant.
Figure 2B:
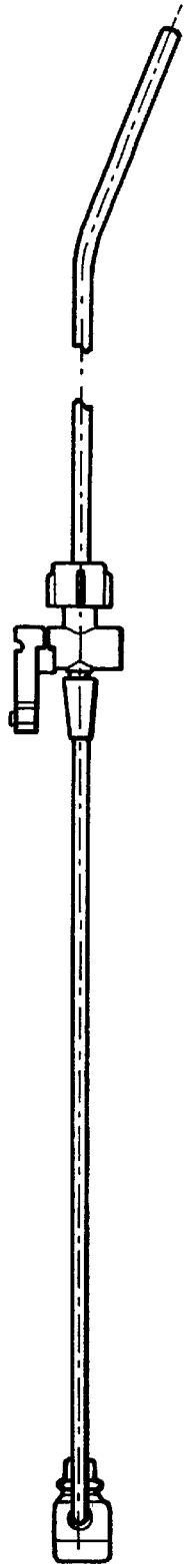
Figure 2A:
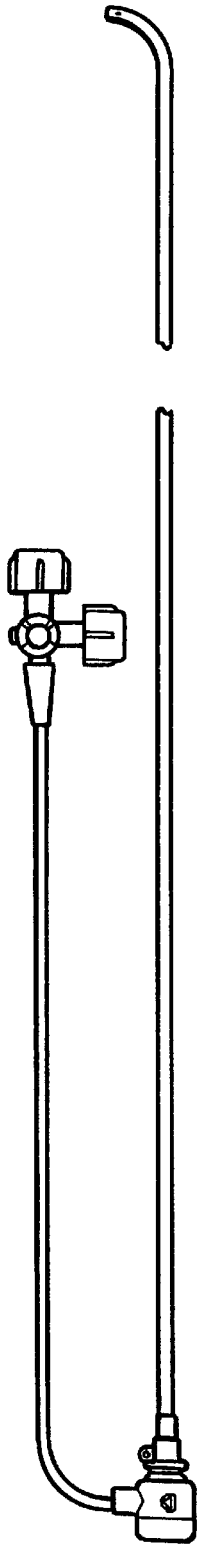
Figure 1:
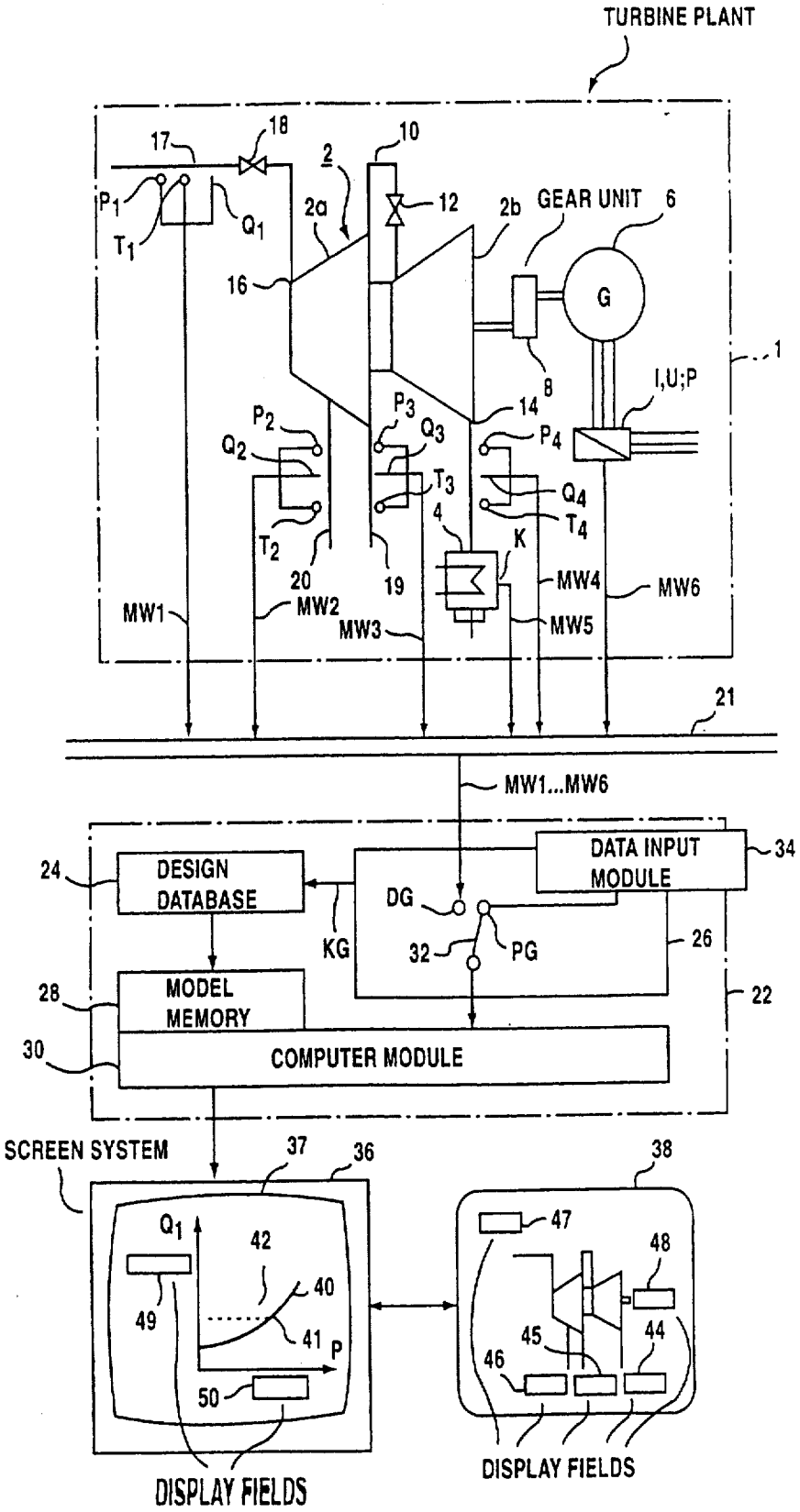
Figure 2A:
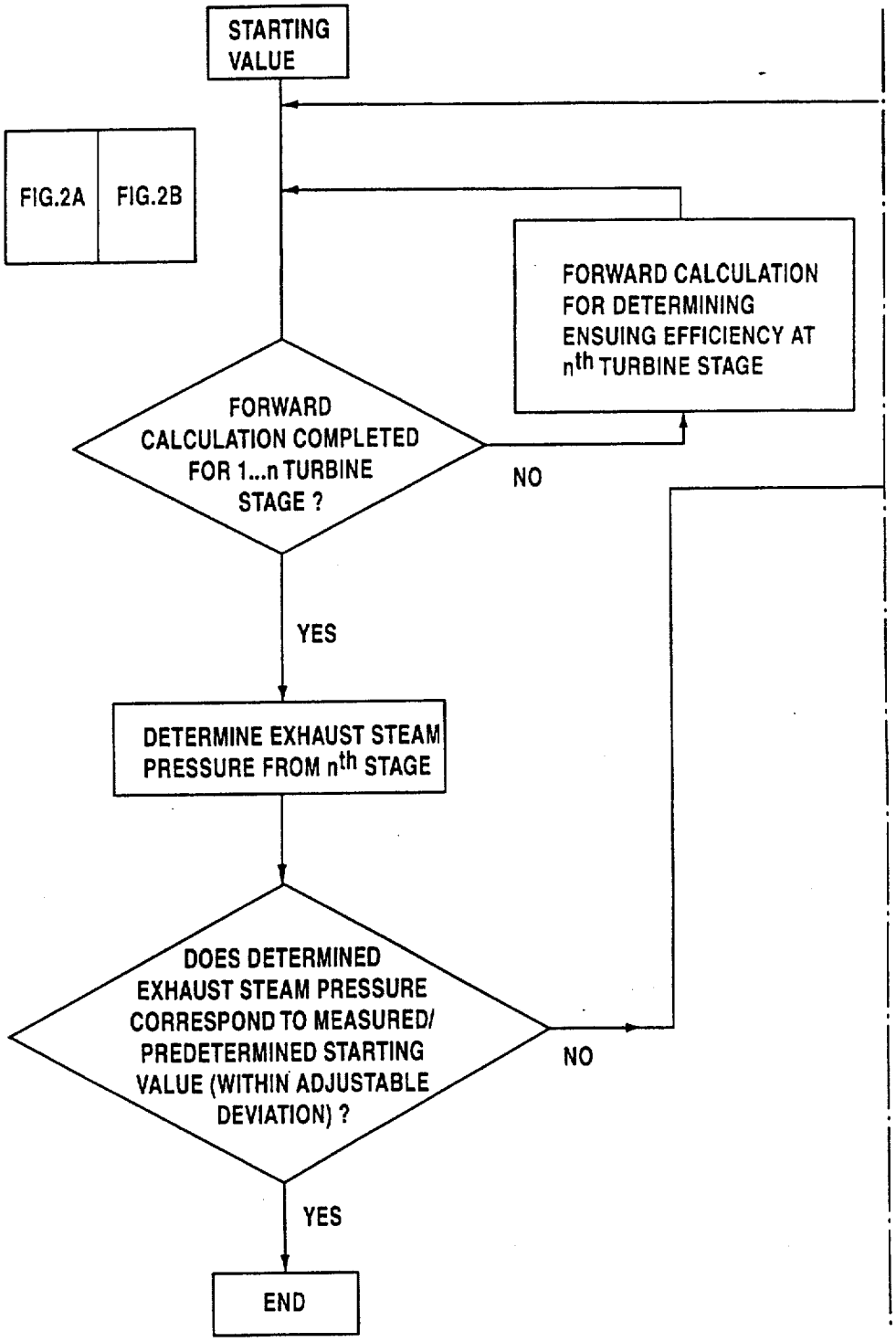
Figure 2B:
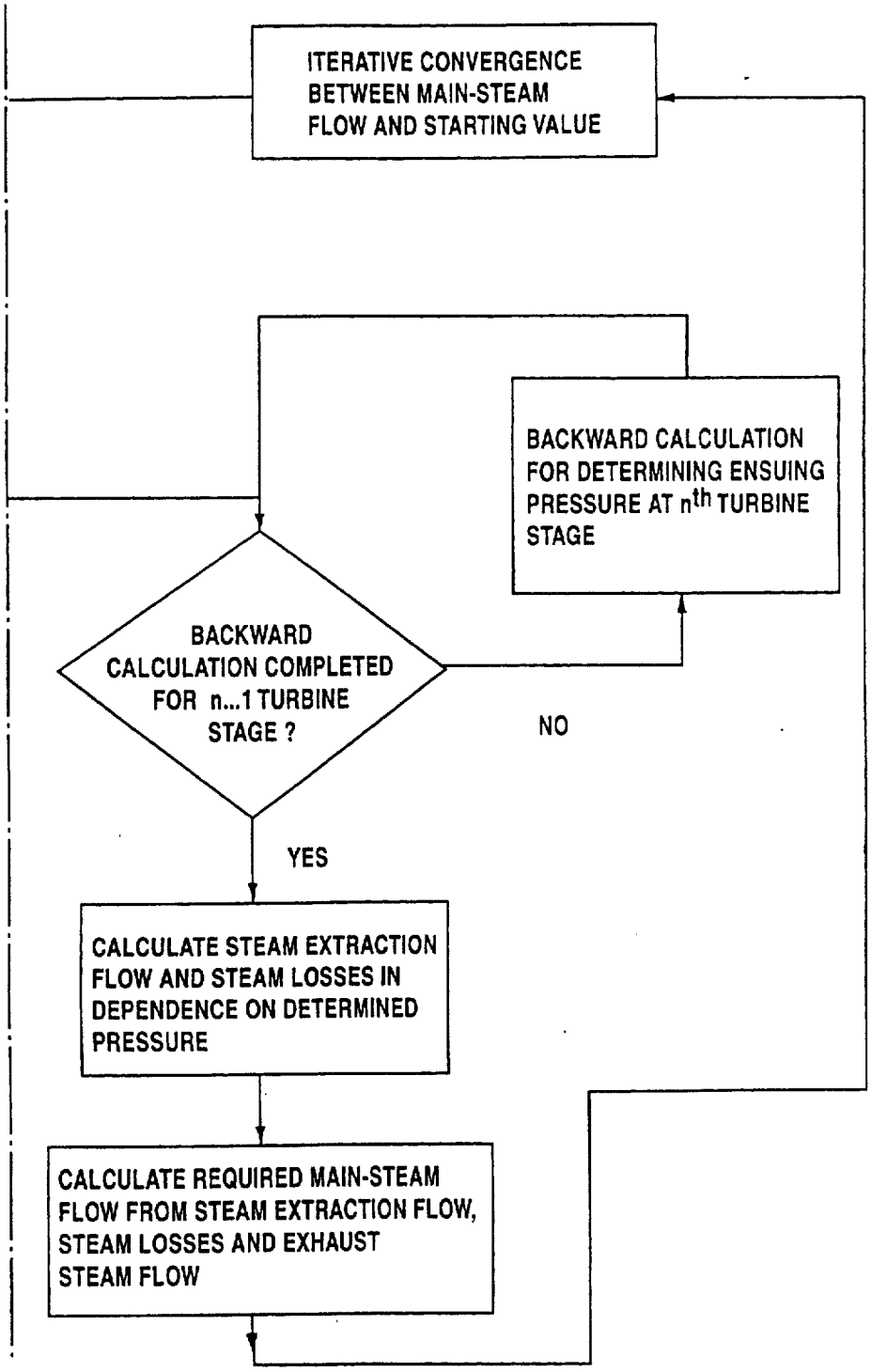

It is certified that error appears in the above-identified patent and that said Letters Patent is hereby corrected as shown below:

Figures 1, 2A, 2B, should appear as follows:

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*